United States Patent [19]

Bourgois et al.

[11] Patent Number: 4,628,683

[45] Date of Patent: Dec. 16, 1986

[54] STEEL CORD TWISTING STRUCTURE

[75] Inventors: Luc Bourgois, Waregem-Desselgem; Freddy Baillievier, Zwevegem, both of Belgium

[73] Assignee: N. V. Bekaert S.A., Zwevegem, Belgium

[21] Appl. No.: 748,987

[22] Filed: Jun. 26, 1985

[30] Foreign Application Priority Data

Jul. 9, 1984 [GB] United Kingdom ..... 8417485
Oct. 22, 1984 [GB] United Kingdom ..... 8426654

[51] Int. Cl.[4] ..... D02G 3/48; D07B 1/06

[52] U.S. Cl. ..... 57/213; 57/230; 57/902; 152/556

[58] Field of Search ..... 57/200, 210, 212, 213, 57/214, 215, 230, 235, 3, 6, 9, 12, 13, 15, 311, 902; 152/356, 359

[56] References Cited

U.S. PATENT DOCUMENTS

| | | | |
|---|---|---|---|
| 2,492,352 | 12/1949 | Bourdon | 57/214 X |
| 3,336,744 | 8/1967 | Perne | 57/213 X |
| 4,158,946 | 6/1979 | Bourgois | 57/902 X |
| 4,349,063 | 9/1982 | Kikuchi et al. | 57/215 X |
| 4,488,587 | 12/1984 | Umezawa et al. | 57/213 X |

*Primary Examiner*—Donald Watkins

*Attorney, Agent, or Firm*—Schwartz, Jeffery, Schwaab, Mack, Blumenthal & Evans

[57] ABSTRACT

A steel cord, for use in the reinforcement of resilient articles such as rubber tyres, comprises a central bundle of wires surrounded by a circumferential layer of helicoidally twisted wires. In the central bundle, one can distinguish a core and a surrounding layer, the latter having the same twist pitch as the circumferential layer. In order to reduce wire migration, the wires of the central bundle show a limited number of relative position changes, between 2 and 300 per 30 cm cord length.

20 Claims, 7 Drawing Figures

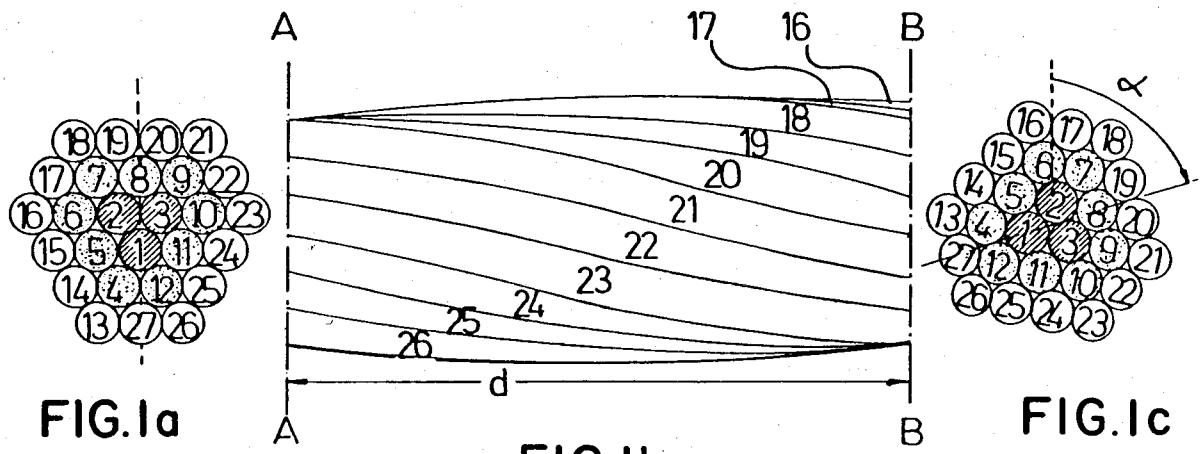
FIG.1a
FIG.1b
FIG.1c
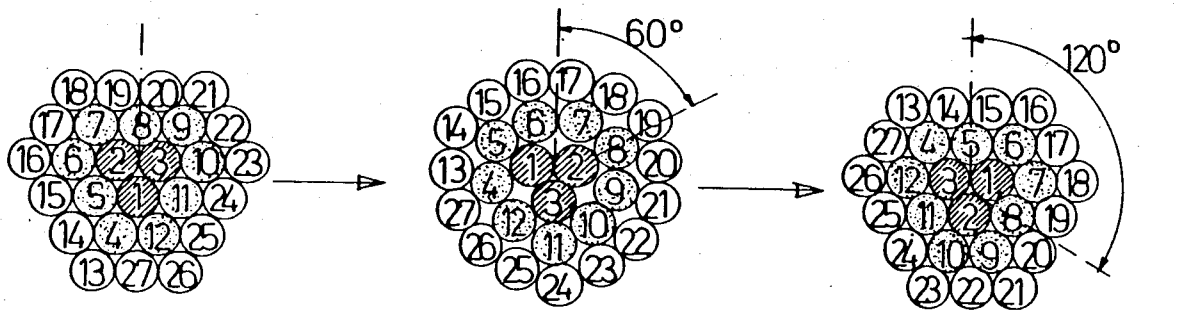
FIG.2a
FIG.2b
FIG.2c

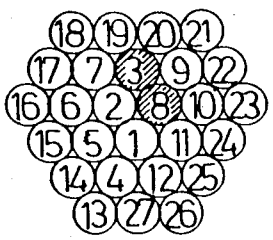
FIG.3a
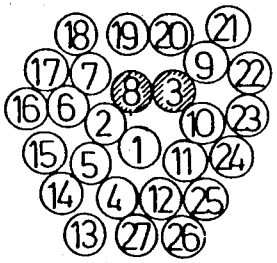
FIG.3b
FIG.3c
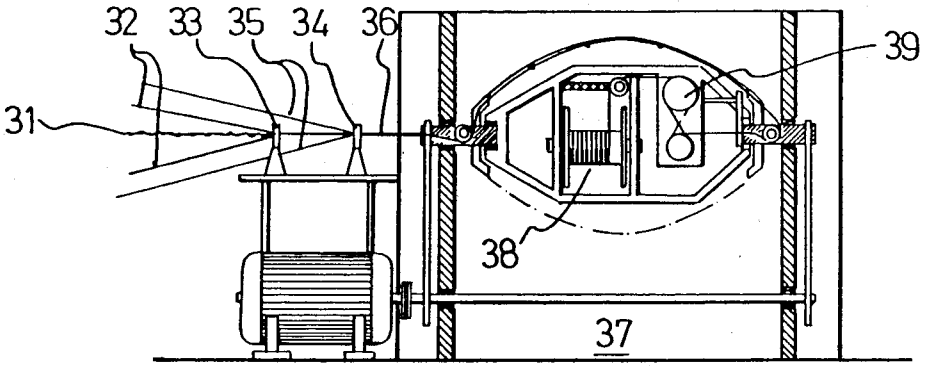
FIG.4

STEEL CORD TWISTING STRUCTURE

BACKGROUND

1. Field of the Invention

This invention relates to a rubber adherable steel cord adapted for reinforcement of resilient articles, such as rubber hoses, rubber belts or vehicle tyres.

2. Related Art

For these applications, such cord will generally be a structure of steel wires, twisted appropriately, the wires having a diameter ranging from 0.03 to 0.80 mm, in general in the range from 0.14 to 0.40 mm, and the steel having a tensile strength of at least 2000N/mm$^2$ and an elongation at rupture of at least 1%, preferably about 2%, being in general carbon steel (preferably 0.65 to 0.95% carbon) in its ferritic state. For these applications, the cord will generally further comprise, in order to obtain the necessary rubber adherability for reinforcement purposes, a rubber-adherable coating, such as copper, zinc, brass or ternary brass alloy, or a combination thereof, the coating having a thickness ranging from 0.05 to 0.40 micron, preferably from 0.12 to 0.22 micron. The coating can also be present in the form of a thin film of chemical primer material for ensuring good rubber penetration and adhesion.

The wires are twisted into a bundle according to a given structure, e.g. twisted strands or superposed layers, and this bundle may or may not be provided with a wrapping filament, helicoidally wound around the bundle. In determining below any twisting structure and number of filaments, this wrapping filament is not taken into consideration, and may or may not be present in addition.

For truck tyre belt and carcass in particular, the requirements for a suitable cord structure are specifically: high tensile strength (which needs a structure with a minimum of cabling loss), good compactness (in order to obtain thin reinforcement plies, necessary specifically in the belt area of the tyre), high fatigue resistance (by inter alia less fretting in the contact points between wires), low moisture penetration possibility (for corrosion resistance), and simple manufacturing method (for reduced costs). For this use, the cords generally have a steel cross-sectional area ranging from 0.5 to 3.5 mm$^2$.

For meeting these requirements, a cord has been developed of the 7×4×0.22 SZ-type, which means: a structure of 7 strands twisted around each other in the S-direction, each strand comprising 4 wires of 0.22 mm diameter twisted around each other in the Z-direction. But cord manufacturers are in continuous search for improved cord structures, trying to reconcile in a still better way the often contradictory requirements for such cord.

In this respect, a 3+9+15×0.22 SSZ-cord is known (which means: a core of three wires twisted around each other in the S-direction, surrounded by a layer of nine wires, twisted around the core in the S-direction, the whole being surrounded by another layer of fifteen wires, twisted in the Z-direction, all wires having a diameter of 0.22 mm) developed as an alternative for the 7×4 type, in particular for its lower cabling loss, better compactness and less fretting.

In the search to even better structures, a further alternative has been proposed, consisting of a single-bundle 27×1 structure in a compact configuration and with a longitudinally regular twist. By a 27×1-structure is meant a bundle of 27 wires, all twisted in the same direction and with the same pitch. By a "compact" configuration is meant that the transverse section of the cord shows a number of nearly circular wire cross-sections of the same diameter (neglecting the fact that the wires are not perfectly perpendicular to the cord cross-section, which leads to a slightly elliptic form), arranged in a close-packed array so that, when the centres of all these circles are connected, there is formed a network of equilateral triangles of which the sides are equal to the wire diameter. By a "longitudinally regular twist" is meant that in the longitudinal direction, successive transverse sections show the same or similar configurations, although phase-shifted with respect to each other, i.e. the cross-section of each wire is in the same position in the array with respect to the cross-section of the other wires, although there will be a shift of the whole configuration, i.e. a rotation around the centres of the transverse sections, due to the twist, through an angle which is proportional to the distance between successive transverse sections. The configurations in all transverse sections are thus in principle identical, but due to some inevitable twisting imperfections, in practice any wire cross-section can be shifted from its ideal position (where it should be when the configurations would be identical, by a distance of about one fourth of a cord diameter) in which case the configurations are called "similar".

In the 27×1 compact cord with longitudinally regular twist above, one can distinguish: a central bundle of steel wires and a circumferential layer of steel wires, (a "layer" having only a thickness of one wire diameter) helicoidally twisted around said central bundle, the latter showing in transverse cross-section a core of adjacent wire cross-sections, surrounded by a ring of wire cross-sections (a "ring" being meant to be a succession one after another along a generally circular path, so that the ring can only have a width of one wire diameter).

In this compact and regular structure, which can be made simply in a single twisting operation, adjacent helicoidal wires are stacked together in their most compact configuration in perfect parallellism, contacting each other along a line instead of in cross-points, so that fretting is very low. Such compactness also results in a better resistance to cutting as reflected by an impact test. Unfortunately however, this cord produces the phenomenon of "wire migration". The cords are generally used in practice in e.g. tyre plies in the form of cut lengths of 35–55 cm, and in running tests of a tyre, one or more wires have been found to shift lengthwise with respect to their neighbours, and emerge at one end of the cord, at one side of the ply, over a certain length, puncturing through the rubber and damaging the tyre. For this reason, this latter cord does not seem to be a good candidate to replace the 7×4 or the 3+9+15 cord mentioned above.

SUMMARY

It is an object of the present invention to provide an n×1-cord with a new twisting structure, retaining as much as possible the advantages of the compact and regular single-bundle multiwire structure above, without however suffering from the wire migration phenomenon.

According to the invention, there is provided a rubber adherable steel cord for the reinforcement of resilient articles, still in the form of a central bundle of steel wires surrounded by a circumferential layer of steel wires, helicoidally twisted around said central bundle, the latter showing in transverse cross-section a core of adjacent wire cross-sections, surrounded by a ring of wire cross-sections, the cord still having a longitudinally regular twist. But the invention is characterized by the exception with respect to perfect regularity by at least two, and maximum three hundred position changes of any wire per 30 centimeter of cord length, such wire being in said central bundle.

Whilst the low fretting figure is caused by the perfect regularity of the 27×1-compact and regular cord, it has now been found indeed that this regularity appears to be responsible for the migration. Investigations have shown that wire migration occurs by helicoidal sliding, under the small alternating torsions of the cord during the tyre running test, of one or more wires inside the helicoidal tunnel defined by the surrounding wires, the wire and tunnel matching each other perfectly.

It has now also been found that a slight departure from perfect regularity (by position changes of the wires) of such cord is sufficient to prevent migration, without already sensibly affecting the fretting figures, and the good cutting resistance, which are characteristic for compact and regular cord. And it has also been found that the wires of the circumferential layer never migrate and appear to be sufficiently held by the surrounding rubber, so that the position changes are only required in the central bundle.

Thus, the concept of the compact and regular structure above need not be abandoned because of migration, in so far as a limited departure from compactness and from perfect regularity is applied which can be small enough not to sensibly affect the fretting performance, and this is facilitated by the fact that the circumferential layer doesnot need any irregularity by any position switch, so that the irregularities can be concentrated in the central bundle of the cord. This does however not mean that some incidental wire exchanges with the circumferential layer would be prohibited.

A way to obtain a limited departure from compactness and perfect regularity consists in providing said central bundle in the form of a core of wires twisted around each other in the same direction, but with a different pitch with respect to the twist pitch of the circumferential layer, and a layer of wires, twisted around said core in the same direction and with the same pitch as the wires of the circumferential layer, where the position changes are caused by the difference of twist pitch of the core with respect to the circumferential layer, as explained hereinafter with respect to a first embodiment.

In a second embodiment, the arrangement is such that the array of wires remains compact for at least 50% and generally between 70% and 97% of the cord length. This is the case, as shown hereinafter, when the core wires are twisted in the same direction and with the same pitch as the wires in the circumferential layer, where a limited number of position switches inside the central bundle are present.

BRIEF DESCRIPTION OF THE DRAWING

Reference will now be made to the accompanying drawings, in which:

FIGS. 1*a*, *b* and *c* show one side view and two cross-sections of a compact and regular cord structure as known in the art;

FIGS. 2*a*, *b* and *c* show three transverse sections, taken consecutively along the length of a cord, in a first embodiment of the invention, by way of example only;

FIGS. 3*a*, *b* and *c* show three transverse sections, taken consecutively along the length of a cord, in a second embodiment of the invention, by way of example only;

FIG. 4 shows a double-twister assembly for twisting a cord of the first embodiment;

DETAILED DESCRIPTION

Figure 5:
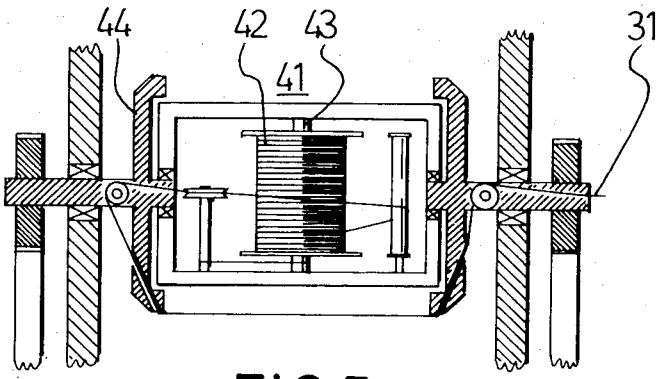
FIG. 5 shows an unwinding assembly for use in conjunction with such double-twister.

In FIG. 1*b*, a prior art 27×1 compact and regular cord is shown in side-view. Two transverse sections AA and BB are taken at a certain distance d from each other, and the configurations are shown in FIGS. 1*a* and 1*c* respectively. FIG. 1*a* shows how the wires are stacked together into a compact configuration, or closed packed array, as defined above. The wires come in this way to lie into a configuration with a hexagonal circumference. At a distance d, the transverse section shows the same configuration, but rotated around the centre of the cord transverse section through an angle $\alpha$, which is equal to $$\frac{d}{p} \times 360°,$$

p being the pitch of the cord. As shown by the wire numbers, all the wires keep the same relative position with respect to the other ones in the configuration, and this remains the case when the cross-section BB is taken at larger and larger distance d. In this way, this cord is a cord, with a longitudinally regular twist as defined hereabove.

In this 27×1-cord, one can distinguish a central bundle of 12 wires, numbered 1 to 12 in FIG. 1, and a circumferential layer of 15 wires, numbered 13 to 27 in the Figure. The latter wires are helicoidally twisted with a pitch p in the Z-direction around the central bundle. The central bundle has all its wires twisted together in the same Z-direction, with the same twist pitch p. When considering the transverse section, one can distinguish in this central bundle a core of adjacent wire cross-sections, (the hatched cross-sections, numbered 1 to 3) and this core is surrounded by a ring of 9 wire cross-sections (the dotted cross-sections, numbered 4 to 12).

The manner in which a first embodiment can depart from this regular configuration is shown in FIG. 2. This figure shows three successive cross-sections of the cord according to the invention in FIGS. 2*a*, 2*b* and 2*c* respectively. The cord comprises again a central bundle of 12 wires, numbered 1 to 12 in the Figure, and a circumferential layer of 15 wires, numbered 13 to 27, twisted around the central bundle in the Z-direction with a pitch p. The transverse section of the central bundle shows again a core of adjacent wire cross-sections, numbered 1 to 3, and this core is again surrounded by a ring of 9 wire cross-sections, numbered 4 to 12. These wires 4 to 12 are helicoidally twisted around the core in the same direction and with the same twist pitch p as the wires 13 to 27 of the circumferential layer. This can be seen by the comparison of the transverse section of FIG. 2*a*, with the successive sections of FIGS. 2*b* and 2*c*. The sections of FIGS. 2*b* and 2*c* are taken at a distance of p/6 and p/3 respectively, and consequently, the phase-shift of the configuration of the wires 4 to 27 is of 60° and 120° respectively in FIGS. 2*b* and 2*c* compared to FIG. 2*a*. But apart from this phase-shift, due to the fact that all wires 4 to 27 have the same pitch, the relative position of all these wire cross-sections with respect to each other is the same. The core however, comprising the wires 1 to 3, is twisted in the same direction but with a pitch which is different from p and in this example a pitch of p/2. In this way, when the wires 4 to 27 show a phase-shift of 60°, the core shows already a phase-shift of 120° (FIG. 2*b*) and, when the wires 4 to 27 show a phase-shift of 120°, the core shows a phase-shift of 240° (FIG. 2*c*).

At the location where the transverse section of the cord according to FIG. 2*a* is taken, the relative positions of the core wire cross-sections 1 to 3 with respect to the other cross-sections 4 to 27 is such, that the wires can arrange themselves into a compact configuration. But a small distance further, this is no longer possible, because a phase-shift between the core and the other wires is building up, and a maximum of departure from the compact configuration is shown in FIG. 2*b*, when the phase-shift between both reaches 120°−60°=60°, where the protrusions of the core are opposite to the protrusions of the surrounding ring. However, when the phase-shift between both reaches 240°−120°=120° (FIG. 2*c*), then the protrusions of the core fit again in the recesses of the surrounding ring, and the wires again fall into a compact configuration. And this provides for this cord a high degree of compactness, with a better resistance to cutting, as reflected in the impact test.

The result is, that the wires 13 to 27 of the circumferential layer are in line contact with the wires 4 to 12 of the surrounding ring, whereas these latter wires have a small number of contact points with the core wires. This is unsufficient to increase the fretting figure appreciably, as will appear from the test given below, but appears to be sufficient to provoke a mutual anchoring of the ring wires with the core wires to prevent wire migration.

In the case of FIG. 2, the transition from the close packed configuration of FIG. 2*a*, through the non-close packed configuration of FIG. 2*b*, to that of FIG. 2*c* comprises the change of position of wire 1 towards the position of wire 2, the latter in its turn makes a change of position towards the position of wire 3, whereas wire 3 takes the original position of wire 1. This means 3 wires changed their position or 3 position changes in ⅓ pitch length p, or 9 position changes per pitch length p of the circumferential layer. In this example, the wire diameter is 0.22 mm and the pitch length p is 18 mm, so that this cord shows 150 position changes in the central bundle per 30 cm cord length. It will be noted that the position changes occur in the core.

Such a cord according to FIG. 2 can e.g. be made by bundling together a central strand of three wires, twisted in the Z-direction with a pitch of 18 mm, with a surrounding first layer of 9 parallel wires, and with a further external layer of 15 parallel wires, and introducing this bundle into a double-twist bunching machine, which gives the parallel wires a twist pitch p of 18 mm in the Z-direction, whereby the central strand becomes a core with a twist pitch of 9 mm. This is shown in FIG. 4, where the central strand 31 and the surrounding ring 32 of nine parallel wires is formed in a first forming die 33, where the so formed bundle emerges in the direction of a second forming die 34, where the external ring 35 of fifteen parallel wires is joined to the bundle to form the total bundle 36 of twenty-seven wires which is introduced in the double-twister 37, well known in the art, towards the winding-up spool 38. The guiding elements defining the travelling path of the cord through the double-twister between the forming die 34 and the positively driven capstan 39 (which draws the cord through the double-twister) shall produce a minimum of friction.

Another possibility is to use the double-twister of FIG. 4 in the same way, to unwind the central strand 31 from an unwinding unit 41 having an unwinding spool 42 (FIG. 5) with stationary axle 43, over a flyer 44 rotating in the same direction and at the same speed as the flyer of the double twister 37, so that the torsions given by the double-twister 37 to the central strand 31 can travel back towards the exit of the unwinding unit 41 and neutralize against the torsions given in the double twister 37. In this way the central strand does not undergo any torsion on its way from unwinding spool 42 to the winding-up spool 38. But then the central strand on spool 42 will already have its final twist pitch of 9 mm.

This embodiment, according to FIG. 2, is not limited to a twist pitch p of the circumferential layer of 18 mm. This twist pitch will be adapted to the wire diameter and in general range from 50 to 100 times the wire diameter. Nor has the twist pitch of the core to be equal to p/2, in so far as it is sufficiently different from the twist pitch p so as to provide the explained mutual anchoring effect of the ring wires with the core wires over the length of 30 cm which is the minimum length of a cord in the ply of a tyre. In this respect, the difference of pitch will in general be kept above 10 times the wire diameter.

A further second embodiment, showing another manner how to depart, according to the invention, from the regular configuration, is given in FIG. 3. This figure shows three successive cross-sections of such cord in FIG. 3*a*, 3*b* and 3*c* respectively. For the sake of clarity however, the cross-sections are now shown without including the rotation of the configuration, due to twisting, according as the cross-sections progress lengthwise.

The cord comprises again a central bundle of 12 wires, numbered 1 to 12 in FIG. 3, and has again a circumferential layer of 15 wires, numbered 13 to 27, twisted around the central bundle in the Z-direction with a pitch p. When considering the transverse section, shown in FIG. 3*a*, one can again distinguish a core of three adjacent wire cross-sections (1 to 3), surrounded by a ring of nine wire cross-sections (4 to 12). The cross-section of all wires remain in the same relative position with respect to the other wires, except for wires 3 and 8 which exchange position in passing from transverse section (a) in non-close packed configuration at transverse (b); and in non-close packed configuration to transverse section (c), where the wires are in a compact or close packed configuration. FIG. 3*b* shows a transverse section at an intermediate location where the change of position takes place. Thus, there is one position exchange, and as one position exchange means that two wires change position, this means that there are two position changes. A cord of 30 cm length will comprise at least two position changes.

Consequently, in general terms, a position change of a wire of the central bundle with respect to a longitudinally regular twist, is the fact that a wire of this central bundle, when travelling from a first length-section in close packed configuration towards the next length-section in close packed configuration, takes another position than the position it would have if travelling according to a longitudinally regular twist, i.e., a non-close packed configuration.

It will be noted that the position changes are concentrated in the central bundle. This does however not mean that some incidental wire exhange cannot occur with the circumferential layer.

The frequency of position changes along the length of this cord is not too high, so that at least 50% of the cord length, preferably 70 to 97% thereof, will show in transverse section a substantially compact or close packed configuration, the limit between what is to be considered as "substantially compact" and what not being determined below. The remaining part of the cord will have a disturbed, non-compact configuration, caused by the position switch of two wires, as shown e.g. in FIG. 3*b*. Thus, before the exchange of position, the wires are stacked together in substantially compact configuration. In the cord length where the wires 3 and 8 exchange position, the configuration is more or less deviating from the compact configuration. And after the exchange of position, the wires fall again into the compact configuration. In this way, the limited number of position changes is sufficient to prevent wire migration in the central bundle, without excessively affecting fretting figures, and the resistance to cutting as will appear from the test given below.

The cord can be considered as a bundle of wires, all twisted in the same direction and pitch, but with a limited number of position exchanges of the wires in the central part. In this example, the wire diameter is 0.22 mm and the pitch length is 18 mm in the Z-direction. This twist pitch is however not limited to this value, but has to be adapted to the wire diameter and will in general range from 50 to 100 times the wire diameter.

Figure 6:
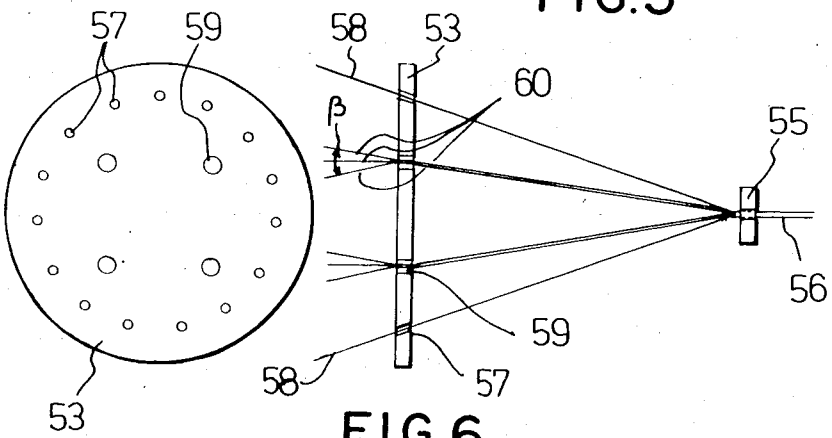
FIG. 6 shows an assembly for guiding the individual wires towards the entrance of a double-twister in order to obtain a cord of the second embodiment.

The cord according to FIG. 3 can be made on a double-twister as shown in FIG. 4, but where the assembly of introducing the wires (forming dies 33 and 34 in FIG. 4) is replaced by an assembly as schematically shown in FIG. 6.

The assembly according to FIG. 6 comprises a distributor plate 53 and a forming-die 55, from which a bundle 56 of wires is guided towards the entrance of the double-twist buncher. The distributor plate 53 has its plane perpendicular to this bundle 56, and comprises a number of guiding-holes, distributed along the plate as shown. The distributor plate comprises firstly an external ring of fifteen guiding holes 57, each serving to guide a single one of the fifteen wires 58 intended for the circumferential layer. These wires are so guided in an invariable position towards the forming-die to assure an unvariable relative position with respect to each other in the cord bundle. The distributor plate further comprises an internal ring of four guiding holes 59, each serving to assemble three converging wires 60, intended for the central bundle. The inevitably unequally distributed tensions and torsions over the wires, imparted by the double twister makes the three wires 60 more or less to change position with respect to each other, so that, for the wires intended for the central bundle, the unvariable position of the wires with respect to each other is not guaranteed.

The frequency of changement of position is controlled by using higher or lower feed tensions, together with the angle of aperture $\beta$ of the converging wires: the greater the angle, the more the position of the wire is imposed. The regularity can also be changed, as a further control means, by distributing the wires, intended for the central bundle, over a larger number of holes 59 in the internal ring of the distributor plate, instead of four as in the Example of FIG. 6.

With respect to the obtained results, the following comparative tests were made. For all cords a steel wire was used comprising 0.72% carbon, 0.56% manganese and 0.23% silicon, the wire being hard drawn to a tensile strength of 2900N/mm$^2$, and covered with a brass layer (67.5% copper) of 0.25 micron thickness.

Figure 7:
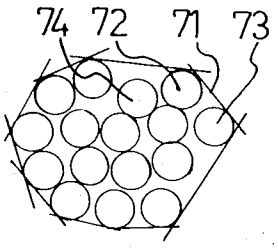
FIG. 7 is a diagram representing a cord cross-section in general.

A transverse section will in general not show a mathematically perfectly compact configuration, but a configuration that is very near to such configuration, i.e. a "substantially compact" configuration. In order to determine as from what perfectness degree a configuration can be called "substantially compact", the surface $S_1$ of a convex polygon is measured, as illustrated in FIG. 7. The polygon is obtained by drawing the common tangent line 71 between two adjacent wire cross-sections 72 and 73 of the circumferential layer, and repeating this for each pair of such wire cross-sections, skipping those sections that would produce a concavity (e.g. cross-section 74). This surface is compared with the total surface $S_o$ of the wire cross-sections, i.e. the effective steel cross-section. The configuration can then be called "substantially compact" if the compactness $$C = \frac{S_0}{S_1} > 0.795$$

although this is not a strict limit for covering the invention in its broadest aspects.

Cord No. 1 is a prior art 3+9+15-SSZ cord as determined above. The three core wires, the nine wires of the first layer and the fifteen wires of the second layer having a twist pitch of 6.3 mm, 12.5 mm and 18 mm respectively. A wrapping wire of 0.15 mm diameter is laid around the cord with a pitch of 3.5 mm in the S-direction. The average compactness C=0.756.

Cord No. 2 is a 27×1 prior art compact cord with a longitudinally perfect regular twist as determined above, with a twist pitch of 18 mm in the Z-direction. A wrapping wire of 0.15 mm is laid around the cord with a pitch of 5 mm in the S-direction. The average compactness C=0.831.

Cord No. 3 is a cord according to the invention, of the type shown in FIG. 2. The pitch of the fifteen wires of the circumferential layer and of the nine wires of the ring around the core is 18 mm in the Z-direction, whereas the pitch of the three core wires depends on the version. In cords 3*a*, 3*b* and 3*c*, the pitch is 9.5 mm, 14 mm and 25 mm in the Z-direction respectively. The diameter, direction and pitch of the wrapping wire is the same as for cord No. 2. The compactness over the length fluctuates between 0.823 (substantially compact structure similar to FIG. 2*a*) and 0.771.

Cord No. 4 is a cord according to the invention, of the type shown in FIG. 3. The pitch of the wire bundle, is 18 mm in the Z-direction and the wrapping wire has the same diameter, pitch and direction as for cord No. 2. Of the 20 randomly taken cross-sections, 16 show a compactness C above 0.795, whereas in the locations of position exchange, the compactness falls down to 0.741.

In the results hereunder the fretting figure is expressed as a percentage of loss of breaking load of the cord in an endless belt test after 180.000 cycles as described in the Special Technical Publication No. 694 of the American Society for Testing and Materials, 1980. The occurrence or absence of wire migration being indicated by an X and an O respectively. The impact test result is given in Joule. This is a test as described in the publication "New Evaluations in Steel Tire cord" by J. Peterson, Winter Technical Symposium Akron Rubber Group, Mar. 6, 1984.

The results are given in the following table:

TABLE I

| Cord Sample | Fretting figure (%) | Wire migration | Impact test (Joule) |
|---|---|---|---|
| 1 | 5 ± 1.5 | O | 6.7 |
| 2 | 2.1 ± 1 | X | 9.2 |
| 3a | 1.9 ± 1 | O | 8 7 |
| 3b | 1.8 ± 1 | O | 8.3 |
| 3c | 1.8 ± 1 | O | 8.0 |
| 4 | 2.3 ± 1 | O | 8.5 |

The invention is of course not limited to cords with 27 wires as shown in the examples above. The core of FIG. 2 can for instance comprise a number N of wires, N ranging from 3 to 5, the twisted layer around the core then comprising N+6 wires and the circumferential layer N+12 wires, these constructions being able to lie in a polygonal compact configuration. If desired, the circumferential layer can comprise one or two wires less than N+12, in order to obtain some space between the wires for better rubber penetration. The wires of the different layers mustnot necessarily have strictly the same diameter. It is possible, for instance, in the case of FIG. 2, to give the wires of the core a diameter of about 0.5 to 10% more than the diameter of the other wires, which produces an improved impact test figure. The other wires can also divert from an equal diameter to the same extent of 10%. (The significance of the diameter of a numer of unequal wires is then that the average diameter of the wires shall be taken.)

In the case of FIG. 3, the central bundle can comprise a pair number 2M of wires, e.g. 12, 14 or 16, and the circumferential layer then can comprise M+9 wires, in order to reach a construction that can lie in a polygonal compact configuration.

In the cases where the wires of the core have a different twist pitch with respect to the wires of circumferential layer, such as in the case of FIG. 2, it has also been found to be advantageous to give the core wires a larger diameter than the diameter of the wires of the layer that directly surrounds the core. It appears that the rupture strength of such cord, when embedded in rubber and measured between Zwick clamps, which take the cord by the rubber, is much better than with cord where the core wires have the same diameter as the wires of the directly surrounding layer. This latter strength test corresponds more with the actual loading of the cord in the tyre. In these cases, the minimum necessary degree of difference of diameter and twist pitch depends on the degree of desired resistance to wire migration, which is not an absolute value. As from a first departure from equality, an improved resistance to wire migration will result without loss of tensile strength of the embedded cord. In general, a difference in diameter of at least 0.5 percent of the core wire diameter will be taken, preferably in the range between 5 and 15 percent diameter, and no greater than 25% difference, and a difference of twist pitch of at least 5 times the core wire diameter will be taken. Preferably, the twist pitch of the core wires will range between 50 core wire diameters below, and 150 core wire diameters above the twist pitch of the surrounding layers.

Such better rupture strength appears from the comparative test below. The steel wires used for the cord are the same as for the cord samples of the table I above.

Cord A is a 27×1 prior art compact cord with a longitudinally perfect regular twist, identical to cord No. 2 of the cord samples of table I above.

Cord B is a 27×1 cord according to the invention, but with the core wire diameter equal to the diameter of the wires of the surrounding layers, and identical to cord No. 3*a* of the cord samples of table I above.

Cord C is a 27×1, having a slightly larger core wire diameter than the diameter of the wires of the surrounding layers, in close-packed cross-sectional configuration, and with a longitudinally perfect regular twist.

Cord D is a 27×1 cord according to the invention, where both the core wire diameter and pitch differ from the diameter and pitch of the surrounding layers.

All these cords are tested to determine their breaking load, i.e. the tensile force to which the cord is submitted at rupture. In a first test, the breaking load of the bare cord is measured with both ends laid in loops along a cylindrical piece and the extremity then fixed to this piece. The free test length is 22 cm. In a second test, the cord is firstly vulcanized in a rubber beam of 40 cm length, 12 mm width and 5 mm thickness. The cord runs lengthwise over the whole length, and is located, in cross-section, in the centre of the rectangular cross-section of the rubber. At each end of this beam, a length of 10 cm of the sample is clamped between two flat clamps, pressing the sample in the direction of its thickness, and a free test length of 22 cm is left between the clamps. In the test, the clamps are then moved away from each other. In this latter test, the tensile forces of the testing machine are imparted through the rubber towards the cord, which is a better simulation of the reinforcing effect of the cord in rubber. In order to eliminate differences in rupture strength, due to the fact that the embedded wire has undergone an ageing in the vulcanization operation, and the bare cord has not, this latter cord is, before the bare cord test, submitted to an ageing of 1 hour at 150° C.

The results are given in the table below, the occurrence or absence of wire migration again being given by X and O respectively

TABLE II

| Cord sample | ϕ core wires (mm) | ϕ layer wires (mm) | Pitch core wires (mm) | Pitch layer wires (mm) | Breaking load bare (N) | Breaking load embedded (N) | Fretting figure (%) | Wire migration |
|---|---|---|---|---|---|---|---|---|
| A | 0.22 | 0.22 | 18Z | 18Z | 2995 | 2735 | 2.1 ± 1 | X |
| B | 0.22 | 0.22 | 9.5Z | 18Z | 2935 | 2680 | 1.9 ± 1 | O |
| C | 0.25 | 0.22 | 17Z | 17Z | 2990 | 2995 | 2.5 ± 1 | X |

TABLE II-continued

| Cord sample | ϕ core wires (mm) | ϕ layer wires (mm) | Pitch core wires (mm) | Pitch layer wires (mm) | Breaking load bare (N) | Breaking load embedded (N) | Fretting figure (%) | Wire migration |
|---|---|---|---|---|---|---|---|---|
| D | 0.25 | 0.22 | 10Z | 18Z | 2987 | 3101 | 3.3 ± 1 | O |

These results show that among cords where the core wires have a different twist pitch with respect to the circumferential layer, such as in FIG. 2, (cords B and D), it is advantageous to choose D, with a slightly larger core wire diameter, for reason of better breaking load.

What is claimed is:

1. A rubber adherable steel cord adapted for reinforcement of resilient articles, in the form of a central bundle of steel wires surrounded by a circumferential layer of steel wires, helicoidally twisted around said central bundle, said central bundle having in transverse cross-section a core of adjacent wire cross-sections, surrounded by a ring of wire cross-section, the cord having a plurality of cord length sections in a close packed configuration, each close packed section being separated from one another by a cord length section in a non-close packed configuration; the wires of the central bundle including at least two, but no more than three hundred, position changes with respect to a longitudinal regular twist.

2. A cord according to claim 1, in which said central bundle comprises a core of wires twisted around each other in the same direction, but with a different pitch with respect to the twist pitch of the circumferential layer, and a layer of wires twisted around said core in the same direction and with the same pitch as the wires of the circumferential layer, said position changes being caused in said central bundle by the difference of twist pitch of the core with respect to the circumferential layer.

3. A cord according to claim 2, in which said core comprises a number N of wires, N ranging from 3 to 5, said twisted layer around the core comprising N+6 wires and said circumferential layer comprising N+12−n wires, n ranging from 0 to 2.

4. A cord according to claim 2, in which the wires of the circumferential layer have a twist pitch ranging from 50 to 100 times the wire diameter, and in which the wires of said core are twisted around each other with a twist pitch which differs from the twist pitch of said circumferential layer by more than 10 times the wire diameter.

5. A cord according to claim 2, in which the wires of the core have a diameter of about 0.5 to 25% of the core wires diameter more than the diameter of the other wires.

6. A cord according to claim 1, in which the lengthwise subsequently taken transverse cross-sections show on an average over at least 50% of the cord length a close packed configuration.

7. A cord according to claim 6 in which said central bundle comprises a pair number 2M of wires, M ranging from 6 to 8, and the circumferential layer comprises M+9 wires.

8. A cord according to claim 1, in which the wires of the circumferential layer are twisted around said central bundle with a twist pitch ranging from 50 to 100 times the wire diameter.

9. A cord according to claim 1 in which the steel cross-sectional area ranges from 0.5 to 3.5 $mm^2$.

10. A cord according to claim 6 wherein said average is in the range of about 70 to 97%.

11. A vehicle tyre reinforced with cord lengths having a central bundle of steel wires surrounded by a circumferential layer of steel wires, helicoidally twisted around said central bundle, said central bundle having in transverse cross-section a core of adjacent wire cross-sections, surrounded by a ring of wire cross-section, the cord having a plurality of cord length sections in a close packed configuration, each close packed section being separated from one another by a cord length section in a non-close packed configuration; the wires of the central bundle including at least two, but no more than three hundred, position changes with respect to a longitudinal regular twist.

12. A vehicle tyre according to claim 11, in which said central bundle comprises a core of wires twisted around each other in the same direction, but with a different pitch with respect to the twist pitch of the circumferential layer, and a layer of wires twisted around said core in the same direction and with the same pitch as the wires of the circumferential layer, said position changes being caused in said central bundle by the difference of twist pitch of the core with respect to the circumferential layer.

13. A vehicle tyre according to claim 11, in which said core comprises a number N of wires, N ranging from 3 to 5, said twisted layer around the core comprising N+6 wires and said circumferential layer comprising N+12−n wires, n ranging from 0 to 2.

14. A vehicle tyre according to claim 11, in which the wires of the circumferential layer have a twist pitch ranging from 50 to 100 times the wire diameter, and in which the wires of said core are twisted around each other with a twist pitch which differs from the twist pitch of said circumferential layer by more than 10 times the wire diameter.

15. A vehicle tyre according to claim 11, in which the wires of the core have a diameter of about 0.5 to 25% of the core wire diameter more than the diameter of the other wires.

16. A vehicle tyre according to claim 11, in which the lengthwise subsequently taken transverse cross-sections show on an average over at least 50% of the cord length a substantially compact configuration.

17. A vehicle tyre according to claim 16, wherein said average is in the range of about 70 to 97%.

18. A vehicle tyre according to claim 11, in which said central bundle comprises a pair number 2M of wires, M ranging from 6 to 8, and the circumferential layer comprises M+9 wires.

19. A vehicle tyre according to claim 11, in which the wires of the circumferential layer are twisted around said central bundle with a twist pitch ranging from 50 to 100 times the wire diameter.

20. A vehicle tyre according to claim 11, in which the steel cross-sectional area ranges from 0.5 to 3.5 $mm^2$.

* * * * *